United States Patent [19]

Aihara et al.

[11] Patent Number: 4,940,423

[45] Date of Patent: Jul. 10, 1990

[54] CONNECTOR APPARATUS

[75] Inventors: Yasuyuki Aihara; Hideki Kano; Yoshikazu Tsuchiya; Noboru Miyazaki, all of Tochigi, Japan

[73] Assignee: Honda Giken Kogyo Kabushiki Kaisha, Tokyo, Japan

[21] Appl. No.: 284,985

[22] Filed: Dec. 15, 1988

[30] Foreign Application Priority Data

Dec. 15, 1987 [JP] Japan ..... 62-189393[U]

[51] Int. Cl.[5] ..... H01R 13/02

[52] U.S. Cl. ..... 439/369; 439/533; 439/345

[58] Field of Search ..... 439/34, 350, 351, 352, 439/353, 354, 355, 356, 357, 358, 345, 369, 488, 489, 491, 527, 533, 529

[56] References Cited

U.S. PATENT DOCUMENTS

| | | | |
|---|---|---|---|
| 1,989,823 | 2/1935 | Raabe | 439/369 |
| 3,132,912 | 5/1964 | Friedman | 439/533 X |
| 3,383,639 | 5/1968 | Anderson et al. | 439/369 |
| 3,484,736 | 12/1969 | Wyse | 439/369 X |
| 4,741,590 | 5/1988 | Caron | 439/369 X |
| 4,746,306 | 5/1988 | Yurtin | 439/357 |

*Primary Examiner*—Neil Abrams
*Assistant Examiner*—Khiem Nguyen
*Attorney, Agent, or Firm*—Lyon & Lyon

[57] ABSTRACT

A connector apparatus comprising male and female connector members and a stay for mounting the connector members in place. A pair of oblong projections are formed on the terminal block portion at the rear end of each connector member so as to be located on opposite sides of the lead wire outlet section of the terminal block portion. The stay is provided with a pair of first elastic hook pieces engageable with the pair of oblong projections of the male connector member and a pair of second elastic hook pieces engageable with the pair of oblong projections of the female connector member. The first and second elastic hook pieces are arranged to face each other with a space therebetween measuring approximately equal to the distance between the terminal block portions of the two connector members when the connector members are completely assembled to maintain the members in assembled condition.

4 Claims, 1 Drawing Sheet

CONNECTOR APPARATUS

BACKGROUND OF THE INVENTION

This invention relates to a connector apparatus primarily for use in a vehicle wiring system and comprising male and female connector members and a stay for mounting the connector in place.

There has been known from the Japanese Utility Model Registration Application publication Sho No. 62-15783 a connector of this type wherein a locking pin is attached by insertion through one side wall of a female connector member in such a way that the pin is slidable and urged outwards by a spring. The locking pin extends across the internal space of said connector member so as to be able to be screwed into a tapped hole provided in the other side wall of said member. The male connector member is provided with a throughhole located to be aligned with the holes in the female connector member when properly assembled to receive locking pin so that both the connector members are locked together when the locking pin is pushed through the throughhole into the tapped hole and screwed thereinto.

For the above-described connector, a locking pin and a spring to urge the same have to be provided separately, which means more separate parts are required. In addition, it takes more time and labor to lock the members in place because the locking pin has to be screwed into the tapped hole for locking. Furthermore, since it is necessary to provide a through hole in the main body portion of the male connector member and in the female connector member, there is a problem of less design freedom with respect to the layout of the electrical terminals in the main body portion.

Also a conventional connector used for wiring in a vehicle usually is mounted on the vehicle body by means of a stay. Therefore, it is an object of the present invention to provide a connector apparatus in which the stay is so designed as to concurrently serve also as a locking device for locking the connector members together in the properly assembled condition, thereby solving the foregoing problems of the prior art.

SUMMARY OF THE INVENTION

To achieve the above objective, the present invention provides a connector apparatus comprising male and female connector members and a stay for mounting the connector in place, wherein a pair of oblong projections are formed on a terminal block portion at the rear end of each connector member so as to be located at both outer sides with respect to the lead wire outlet sections of the terminal block portion, and the stay is provided with a first pair of elastic hook pieces engageable with said pair of oblong projections of the male connector member and a second pair of elastic hook pieces engageable with said pair of oblong projections of the female connector member, said first and second elastic hook pieces on the same side being so arranged as to face each other with a space therebetween measuring approximately equal to the distance between the terminal block portions of the two connector members when the connector members are properly assembled.

As the connector apparatus consisting of the assembled male and female connector members is pressed in between the first and the second elastic hook pieces of the stay, these elastic hook pieces become engaged with the respective projections formed on the terminal block portions at the rear ends of the connector members, so that both the male and female connector members are pressed inwards from both sides thereof by the elastic force of the first and the second elastic hook pieces and brought into the properly assembled condition, in which condition the connector is thus kept locked by the stay.

These projections are so provided and located on the terminal block portion of each connector member at both outer sides with respect to the lead wire outlet section of the terminal block portion, whereby the pairs of elastic hook pieces can engage the projections without interfering with the lead wires. This arrangement also makes the connector apparatus engaged at four points with the stay and thus securely held thereon.

Unlike the prior art in which a through-hole is formed in the main body portion of the male and female connector members, each connector member according to the present invention is free from the otherwise inevitable design limitations caused by such a hole with respect to the layout of the electrical terminals.

BRIEF DESCRIPTION OF THE DRAWINGS

A preferred embodiment of the present invention will now be described with reference to the accompanying drawings, wherein.

DETAILED DESCRIPTION

Figure 1:
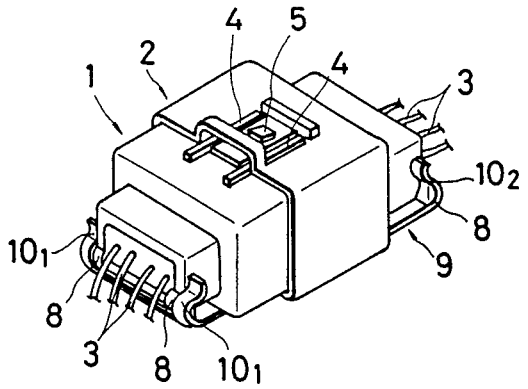
FIG. 1 is a perspective view of an assembled connector apparatus according to the present invention.
Figure 2:
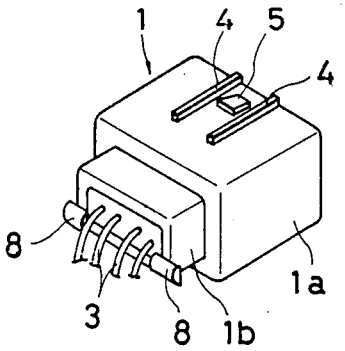
FIG. 2 is a perspective view of the male connector member thereof.
Figure 3:
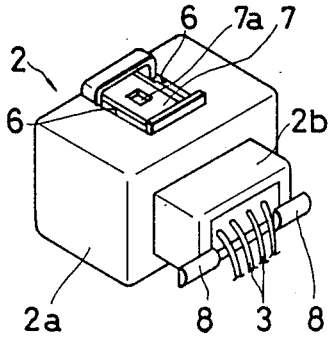
FIG. 3 is a perspective view of the female connector member thereof.

Referring to FIG. 1, a male connector member 1 and a female connector member 2 as shown in the completely and properly assembled condition and installed on a stay 9. As shown in FIGS. 2 and 3, each of the connector members 1 and 2 comprises a box-shaped main body portion 1*a* or 2*a* and a terminal block portion 1*b* or 2*b* provided at the rear end of the connector member for the exit of the lead wires 3. On the top surface of the main body portion 1*a* of the male connector member 1 are formed a pair of left and right ridges 4 and 4 and an intermediate projection 5 therebetween. On the top surface of main body portion 2*a* of the female connector member 2 are formed a pair of slits 6 and 6 designed to receive the ridges 4 and 4 therein and a tongue piece 7 therebetween. When both the connector members are assembled to each other and brought into their properly assembled condition, the intermediate projection 5 becomes engaged with a locking hole 7*a* formed in the tongue piece 7 so that the connector members 1 and 2 are locked in the properly assembled condition.

However, this locking arrangement alone is not effective enough to prevent defective assembly of the connector members under all circumstances, in that the intermediate projection 5 sometimes becomes disengaged from the locking hole 7*a* due to an upward movement of the tongue piece 7 caused by vibrations and movements of the vehicle. It can also happen that an assembly worker, unaware that the two connector members 1 and 2 are still in only a partially or incompletely assembled condition in which the projection 5 is not yet engaged with the locking hole 7*a*, will mount the partially assembled connector onto the mounting base plate of the vehicle body.

Figure 4:
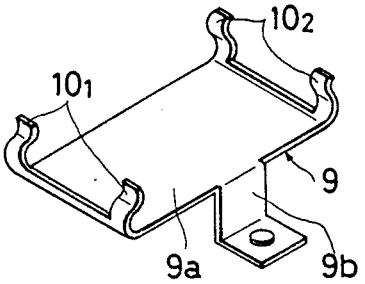
FIG. 4 is a perspective view of the stay thereof.

In view of the foregoing problems, there are formed on each of the terminal block portions 1*b* and 2*b* of the connector members 1 and 2 a pair of oblong projections 8 and 8 so located as to be at both outer sides with respect to the lead wire outlet section of said terminal block portion. As shown in FIG. 4, the connector-mounting stay 9 to be fastened to the mounting base plate of the vehicle body is provided with a pair of first elastic hook pieces $10_1$ and $10_1$ engageable with the corresponding pair of the oblong projections 8 and 8 of the male connector member 1 and a pair of second elastic hook pieces $10_2$ and $10_2$ engageable with the corresponding pair of the oblong projections 8 and 8 of the female connector member 2. The first and second elastic hook pieces are so arranged as to face each other with a space therebetween measuring approximately equal to the distance between the terminal block portions 1*b* and 2*b* when the two connector members 1, 2 are in the completely assembled condition. As the connector apparatus consisting of the two connector members 1 and 2 assembled to each other is pressed in between the first and second pairs elastic hook pieces $10_1$ and $10_2$, each projection 8 is engaged by the corresponding one of the hook pieces $10_1$ and $10_2$.

According to the foregoing arrangement even when the two connector members 1 and 2 are in only a partially assembled condition, they are pushed inwards from both sides by the elastic force of the elastic hook pieces $10_1$ and $10_2$ and thus brought into the properly assembled condition. In this manner, the two connector members 1 and 2 are kept pressed together by the stay 9 to the proper condition and held thereby in that condition.

In this embodiment, the elastic hook pieces of each of the pairs, $10_1$, $10_1$ and $10_2$, $10_2$ are so formed that the inner edges of the top-end portions thereof may come in contact with both outer wall surfaces of each of the terminal block portions 1*b* and 2*b* when the two connector members are properly assembled to each other, thereby preventing the connector from slipping out of position sideways. In addition, each of the elastic hook pieces $10_1$ and $10_2$ is shaped to look like a letter "S" when viewed from the side so that the connector may be easily pressed in between these elastic hook pieces $10_1$ and $10_2$.

In the above embodiment, the connector-mounting stay is described and shown as being fastened to the mounting base plate of the vehicle body by means of a tongue piece 9*b* formed integrally with the main body 9*a* of the stay 9 having the hook pieces $10_1$ and $10_2$ erected on both sides thereof. However, it is also possible to form the stay 9 integrally with the mounting base plate of the vehicle body.

As described in the foregoing, the connector apparatus according to the present invention is such that the assembled male and female connector members are kept pressed to their properly and completely assembled condition by a pair of first hook pieces and a pair of second hook pieces integrally formed with the connector-mounting stay and thus are securely held thereby in that condition. This arrangement makes it unnecessary to provide separate locking members and reduces the number of components required, thus contributing to cost reduction while significantly facilitating the assembling work by eliminating any separately performed assembly of a locking device. Another advantage thereof is that, unlike the prior art, the present invention allows a greater design freedom with respect to the layout of the electrical terminals on each connector member.

We claim:

1. A connector apparatus comprising male and female connector members and a stay for mounting the connector members in place, a pair of oblong projections formed on a terminal block portion at a rear end of each connector member as to be located at both outer sides with respect to a lead wire outlet section of said terminal block portion, each said oblong projection comprising a pin which projects outwardly from said terminal block, and a pair of first elastic hook pieces provided on said stay engageable with said pair of oblong projections of the male connector member and a pair of second elastic hook pieces provided on said stay engageable with said pair of oblong projections of the female connector member, said first and second elastic hook pieces being arranged to face each other with a space therebetween measuring approximately equal to the distance between the respective terminal block portions of the two connector members when the connector members are completely assembled to each other; wherein each pair of said first and second elastic hook pieces are so formed and spaced that inner side edges of top-end portions thereof contact surfaces of opposite side walls of each terminal block portion; wherein each of said elastic hook pieces is so shaped as to look like a letter S when viewed from the side.

2. A connector apparatus according to claim 1, wherein a separate engaging projection is provided on an outer surface of the male connector member and a tongue piece is provided on an outer surface of the female connector member, said tongue piece having a hole for engaging said separate engaging projection when the male and female connector members are completely assembled for inhibiting inadvertent disassembly.

3. A connector apparatus comprising male and female connector members and a stay for mounting the connector members in place, a pair of spaced projections formed on a rear end of each connector member and located at opposite sides with respect to a lead wire outlet section of said connector member, each said spaced projection comprising a pin which projects outwardly from said terminal block, and a pair of first elastic hook pieces provided on said stay engageable with said pair of spaced projections of the male connector member and a pair of second elastic hook pieces provided on said stay engageable with said pair of spaced projections of the female connector member, said first and second elastic hook pieces being arranged to face each other with a space therebetween measuring approximately equal to the distance between the projections formed on the two connector members when the connector members are completely assembled for the elastic hook pieces to engage the projections; wherein each of said elastic hook pieces is so shaped as to look like a letter S when viewed from the side for elasticity deforming over and fitting on a said projection; wherein means are provided on the rear end of each connector member for engaging oppositely-facing side edges of each pair of elastic hook pieces for inhibiting sideways movement of said connector members relative to said stay.

4. A connector apparatus as in claims 1 or 2 or 3, wherein each of said elastic hook comprises (1) a first backwardly bent concave portions in the shape of a letter C for accepting therein a said pin, and (2) a second concave portion in the shape of a letter C attached in a direction opposite to that of said first concave portion, whereby so as to look altogether like a letter S when viewed from the side.

* * * * *